United States Patent [19]

Beynet et al.

[11] 4,400,110

[45] Aug. 23, 1983

[54] FLEXIBLE RISER UNDERWATER BUOY

[75] Inventors: Pierre A. Beynet, Tulsa, Okla.; Sam A. Billington, Houston, Tex.

[73] Assignee: Standard Oil Company (Indiana), Chicago, Ill.

[21] Appl. No.: 318,497

[22] Filed: Nov. 5, 1981

[51] Int. Cl.[3] ..... F16L 3/00

[52] U.S. Cl. ..... 405/195; 405/169; 405/170; 166/367

[58] Field of Search ..... 166/350, 359, 367; 405/168, 169, 170, 195

[56] References Cited

U.S. PATENT DOCUMENTS 3,352,356 11/1967 Wakefield ..... 405/169

3,426,842 2/1969 Corley et al. ..... 166/359

3,855,656 12/1974 Blenkarn ..... 166/350

4,279,543 7/1981 Remery ..... 405/195

*Primary Examiner*—Dennis L. Taylor

*Assistant Examiner*—John A. Gungor

*Attorney, Agent, or Firm*—John D. Gassett

[57] ABSTRACT

This invention relates to a floating production system for offshore development of oil and gas wells which employs an underwater buoy to decrease tension on flexible riser pipes used to connect a subsea pipeline to the floating vessel. The underwater buoy utilizes a cradle assembly having a drag balancing tail assembly to counteract the twisting moment applied to the cradle by current drag forces.

6 Claims, 6 Drawing Figures

FLEXIBLE RISER UNDERWATER BUOY

BACKGROUND OF THE INVENTION

This invention relates to the production of oil and gas from a subsea fixture such as an oil well drilled in the bottom of a body of water. It relates especially to a floating production system over such subsea wells wherein flexible riser pipes are connected to the subsea well or subsea pipeline and the other end of the riser pipes are supported at the surface of the body of water by a floating vessel or buoy where it is then conducted to a floating vessel or tanker. In some cases, an underwater buoy is anchored so that the buoy is at an intermediate distance between the surface of the body of water and the bottom, e.g., one-half of the distance. This underwater buoy is provided with a cradle over which the flexible riser passes as supported. One problem with the prior risers and underwater buoy system is that the currents cause the underwater buoys to twist and rotate to the extent that the riser pipes may be damaged to the point where they may rupture.

BRIEF DESCRIPTION OF THE INVENTION

This invention concerns an underwater structure for supporting a flexible riser extending from the bottom of the body of water to a floating vessel. It includes a cradle having a receiving surface over which the riser may extend and be supported and a buoy attached to a cradle for supporting it in the body of water. To counteract the twisting moment applied to the cradle by currents of the water, we provide a drag balancing tail assembly which is attached to the cradle assembly. This drag balancing tail assembly has essentially neutral buoyancy but may have a slight positive buoyancy. The drag balancing tail assembly includes a vertical cylinder with perforations in the walls and in the ends thereof, and an arm member connecting the cylinder to the cradle assembly. The cylinder is perforated so this drag force is more uniform in time and also so that the tail will not flutter. The cylinder is open to vertical flow so that it does not respond to vertical wave motion. Its area and position on the arm is calculated to balance the twisting torque created by the drag on the cradle, buoyancy tank, and riser.

It is thus an object of this invention to provide an improved underwater structure for supporting flexible riser extending from a location on the bottom of the body of water to a floating vessel to prevent the rotation and twisting of the flexible riser.

A better understanding of the invention may be had from the following description taken in conjunction with the drawings.

DRAWINGS

DETAILED DESCRIPTION OF THE INVENTION

Figure 1:
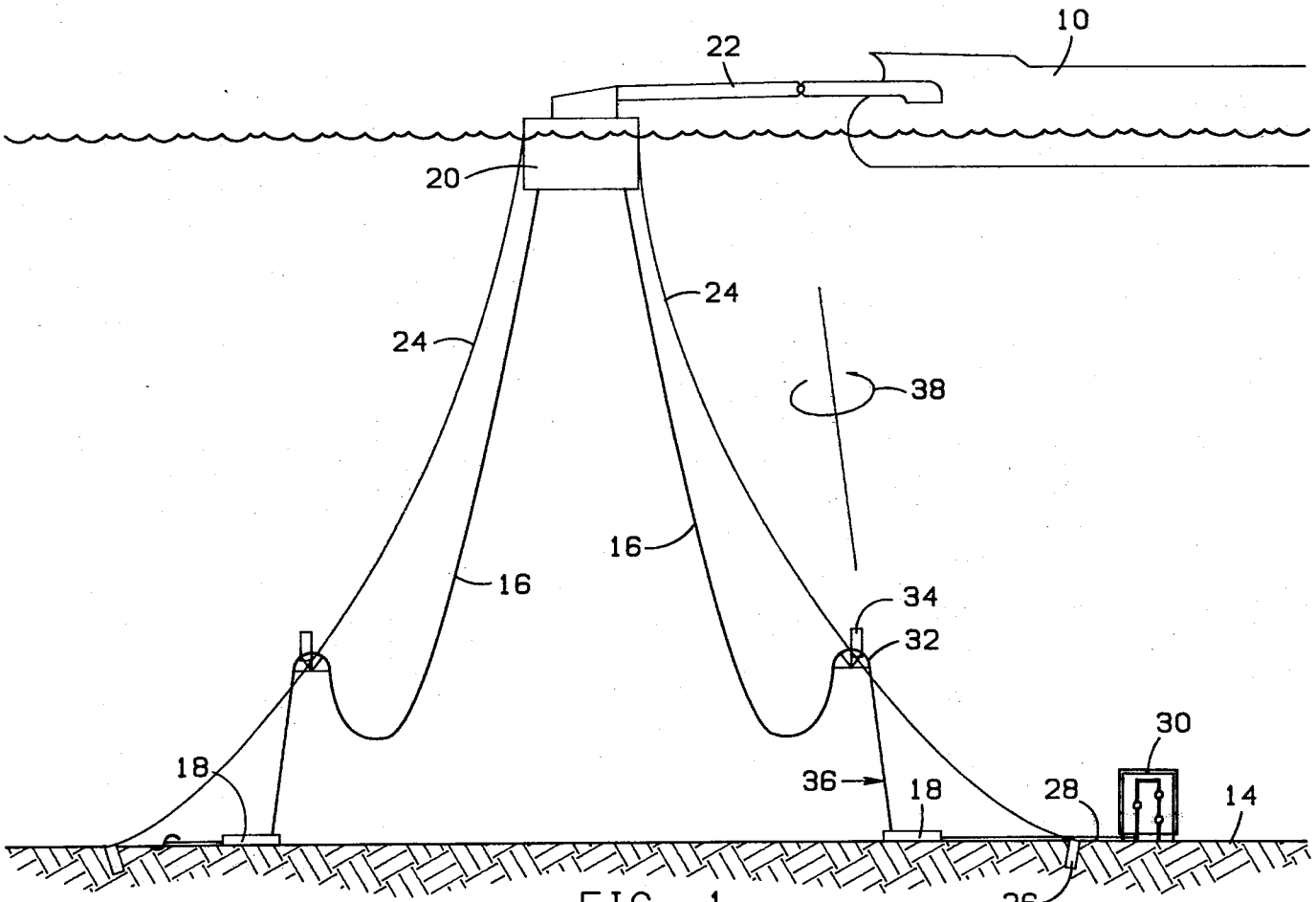
FIG. 1 is a schematic drawing of a system utilizing a flexible riser pipe to connect a subsea well or pipeline to a floating vessel.

Attention is first directed to FIG. 1 which illustrates in schematic form a flexible riser pipe for conducting fluid from a subsea facility to a floating vessel. Shown thereon is a floating vessel 10 floating on a body of water 12 having a bottom 14. Flexible risers 16 are provided to convey fluid from a subsea pipeline end manifold 18 through a catenary moored buoy 20 through a yoke 22 to floating vessel 10. The catenary moored buoy 20 is anchored by anchorlines 24 to anchors 26 provided in the subsea 14. Subsea pipeline end manifold 18 is connected by a plurality of pipes 28 to subsea wells 30.

The flexible riser pipes 16 pass over an underwater cradle assembly having a cradle 32 and a buoy 34. The riser 16 passes over the cradle 32 and the buoy 34 tend to support the riser 16 over the cradle and the riser 16 tends to hold the cradle 32 in the subsea position as determined by the length of the line of the riser 36.

In the system shown in FIG. 1, the significant amplitude twisting (rotation in the horizontal plane is indicated at 38) of the buoyancy tank and cradle, has been determined to be undesirable for two reasons. One reason is that as the cradle rotates in the current, the flexible riser 16 will tend to track out of the cradle and chafe on the cradle edges. Another reason, which is more predominant, is that the twist of the buoyancy tank and cradle also imparts an equal amount of twist on the flexible riser. In many current situations the twist is greater than commercially available flexible riser pipes can withstand.

Figure 5:
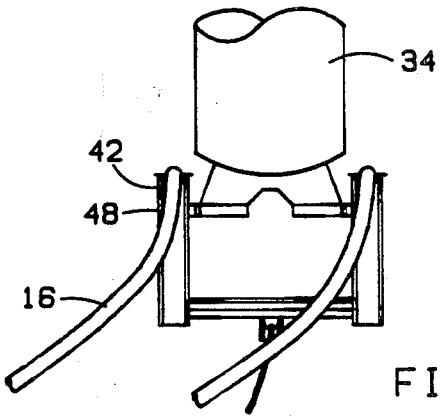
FIG. 5 is a view taken along the line 5—5 of FIG. 4.
Figure 6:
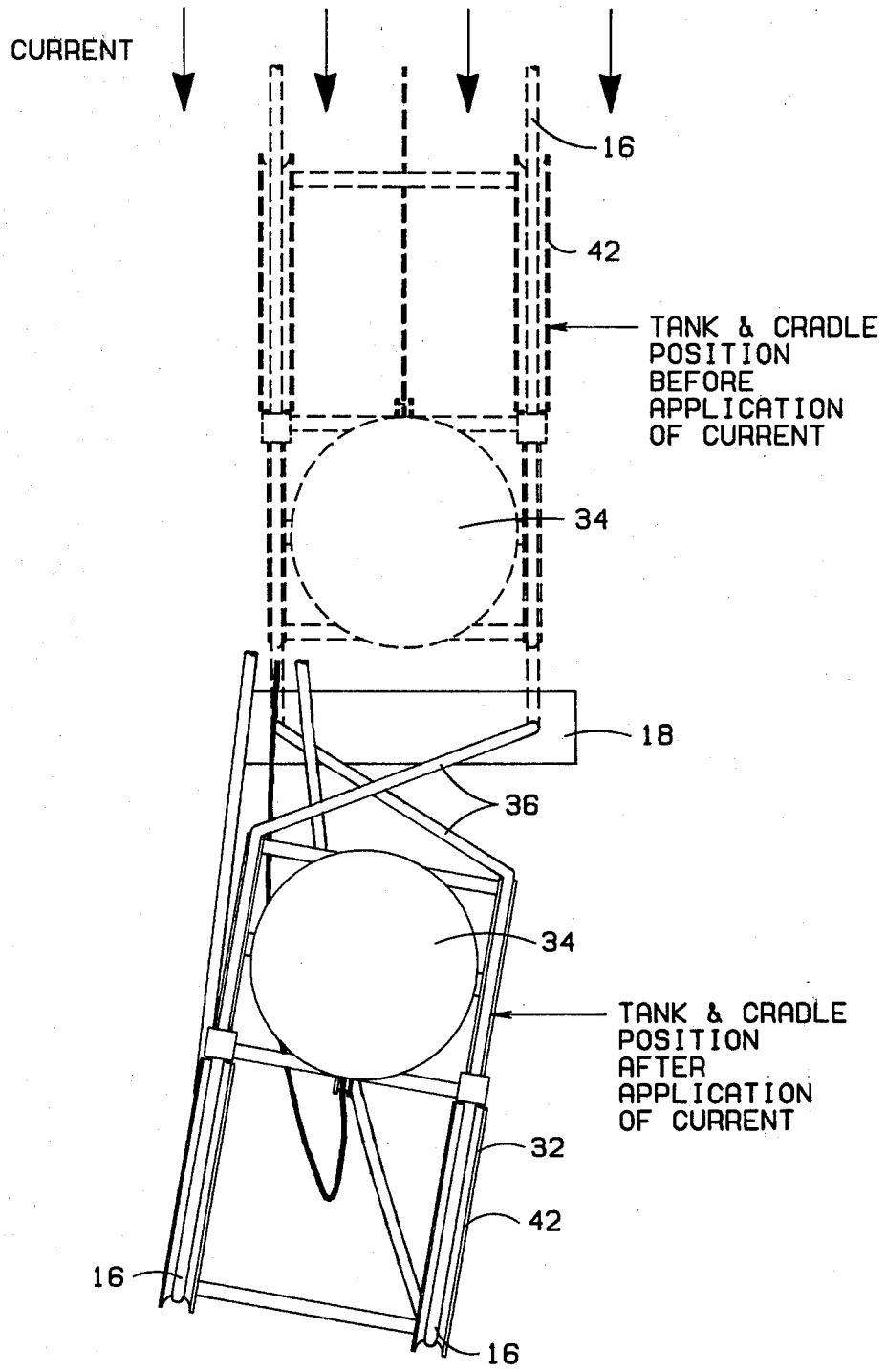
FIG. 6 illustrates the effect of the prior cradle assembly by current parallel to the risers.

A basin model test was run to determine the amount of twist for currents of different velocities and different directions. FIG. 6 illustrates a buoy and cradle position before and after the application of any current. In other words, the model of the cradle 32 and buoy 34 is indicated in dotted lines before the application of any current. As can be seen in FIG. 6, there are two riser pipes 16 which go over a sheave 42. Then parallel current, indicated by arrows 44, was introduced. The reslts were given in the table below. Attention is next directed to FIG. 4 which illustrates the current being perpendicular as indicated by arrows 46. Again, here the former position is indicated in the dotted lines and then the solid lines indicate the position of the cradle assembly after the current has been applied. FIG. 5 illustrates how the riser pipe 16 extends over the edges 48 of sheave 42 as the system rotates. The results of the model tests for both perpendicular and parallel current is given in the table below.

TABLE 1

MODEL TEST RESULTS

| Current | | Other Conditions | | Angle of Twist Observed |
|---|---|---|---|---|
| Velocity | Direction | Waves | Wind | (Deg.) |
| 1 knot | Perpendicular | None | None | 20 → 30° |
| 2 knots | Perpendicular | 56 ft. 12 sec. | Present | Up to 70° |
| 2 knots | Perpendicular | None | None | 30 → 40° |

TABLE 1-continued

MODEL TEST RESULTS

| Current | | Other Conditions | | Angle of Twist Observed |
|---|---|---|---|---|
| Velocity | Direction | Waves | Wind | (Deg.) |
| .433 knot | Perpendicular | None | None | 10 → 15° |
| 2 knots | Parallel | None | Present | Up to 90° |
| 2 knots | Parallel | Present | Present | Up to 180° |

It can be seen that when there were no waves and the current was parallel, the angle of twist was up to 180°. For various perpendicular velocities the twist was anywhere from 10° to 70°. A suitable flexible riser pipe 16 can be a Coflexip sold by the Coflexip S.A. Company. The maximum twist which this particular flexible riser pipe can take is approximately $\frac{1}{3}$° per foot of length which corresponds to a maximum twist of 40° for the example case. It is thus clear that for a very small current the maximum twist on the flexible riser in the system of FIG. 1 is quickly exceeded. Thus, it is clear that the system of FIG. 1 must be improved if it is going to be used safely.

Figure 2:
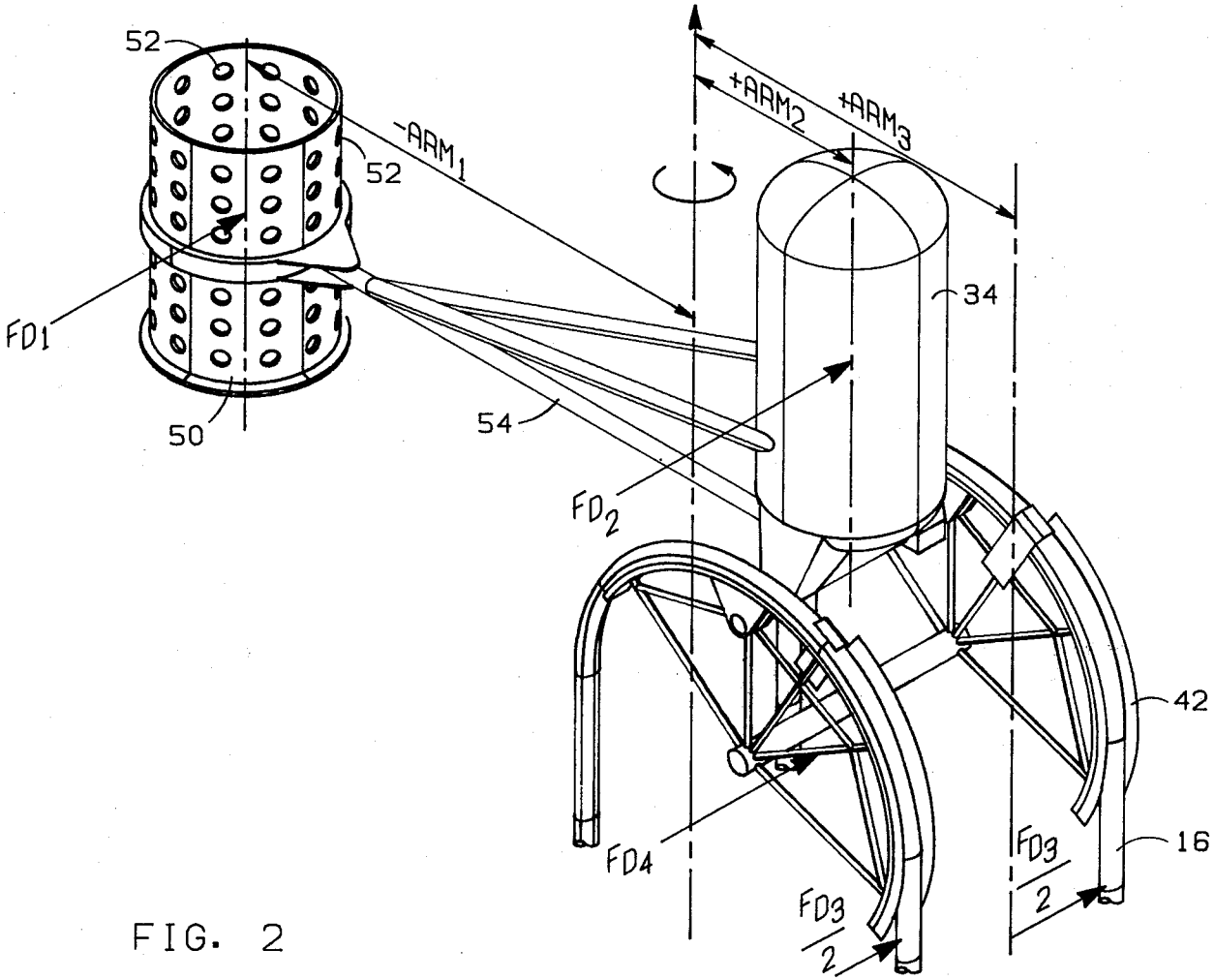
FIG. 2 is an isometric schematic drawing showing the drag balancing tail assembly attached to a cradle assembly.

Attention is next directed to FIG. 2 which illustrates our invention. Shown thereon is riser pipe 16 passing over sheave 42 of the cradle assembly which is supported by the buoy 34. We have provided a drag balancing tail assembly, which is attached to the cradle assembly. It includes a shroud or vertical cylinder 50 having a plurality of perforations 52 in the sides thereof. It is preferred that the top and bottom of cylinder 50 be opened. If it is not opened, it is preferred that the top and bottom be provided with perforations. It is perforated so that the drag force is more uniform in time and also that the tail assembly will not flutter. It is open to vertical flow so that it does not respond to vertical wave motion. The cylinder 50 is supported from a cradle assembly by arm means 54. The area of the cylinder 50 and its position along arm means 54 is calculated to balance the twisting torque on the flexible riser created by drag on the cradle, the buoyancy tank and the riser. This can be calculated using the following equation.

$$\vec{M} = \Sigma F_{Di} * ARM_i = 0$$

where $F_{Di} = \frac{1}{2}\rho C_D A V^2$ where:

$\rho$ = density of water $C_D$ = drag coefficient

A = projected area

V = current velocity

Various terms which go into the equation such as $-ARM_1$, $+ARM_2$, $+ARM_3$, $F_{D1}$, $F_{D2}$, $F_{D3/2}$, $F_{D4}$ are all illustrated in FIG. 2.

The drag tail assembly is thus dimensioned so that the resultant moment, measured on a vertical axis, of the water drag forces is zero. The said vertical axis (N°) passes through the middle point between the contact point of the cradle and the two vertical legs of the flexible riser.

The length of the arm connecting the drag tail to the cradle is maximized to limit the total drag force on the ensemble. The moment should be set to zero when the current is perpendicular to the plane in which the flexible risers lie. However, the design keeps the resultant moment near zero for all horizontal current directions. This is accomplished by the circular drag tail described herein.

The tail is designed to be neutrally buoyant to decrease the required size of the support buoy.

An underwater structure for supporting a flexible riser such as illustrated in FIG. 2 has been built, tested and installed in the Cadlao Field off the Philippine Islands. The size of the structure build included a sheave 42 having a radius of about 10 ft and fitted to receive a 6 inch diameter riser pipe 16. The buoy 34 was approximately 10 ft in diameter and 20 ft long. Cylinder 50 was about 10 ft in diameter and 15 ft long, and was open-ended at the top and bottom. The perforations 52 were about 14 inches in diameter and there were about 72 perforations provided. The distance from the center of cylinder 50 to the center of the buoyancy Chamber 34 was about 33 ft. The cylinder 50 was also provided with floatation means so that it had essentially a neutral buoyancy. This installed system in Cadlao Field is working satisfactorily. It is to be readily understood that various size cylinders 50 and various arm members 54 can be provided without departing from the spirit or scope of this invention.

Figure 3:
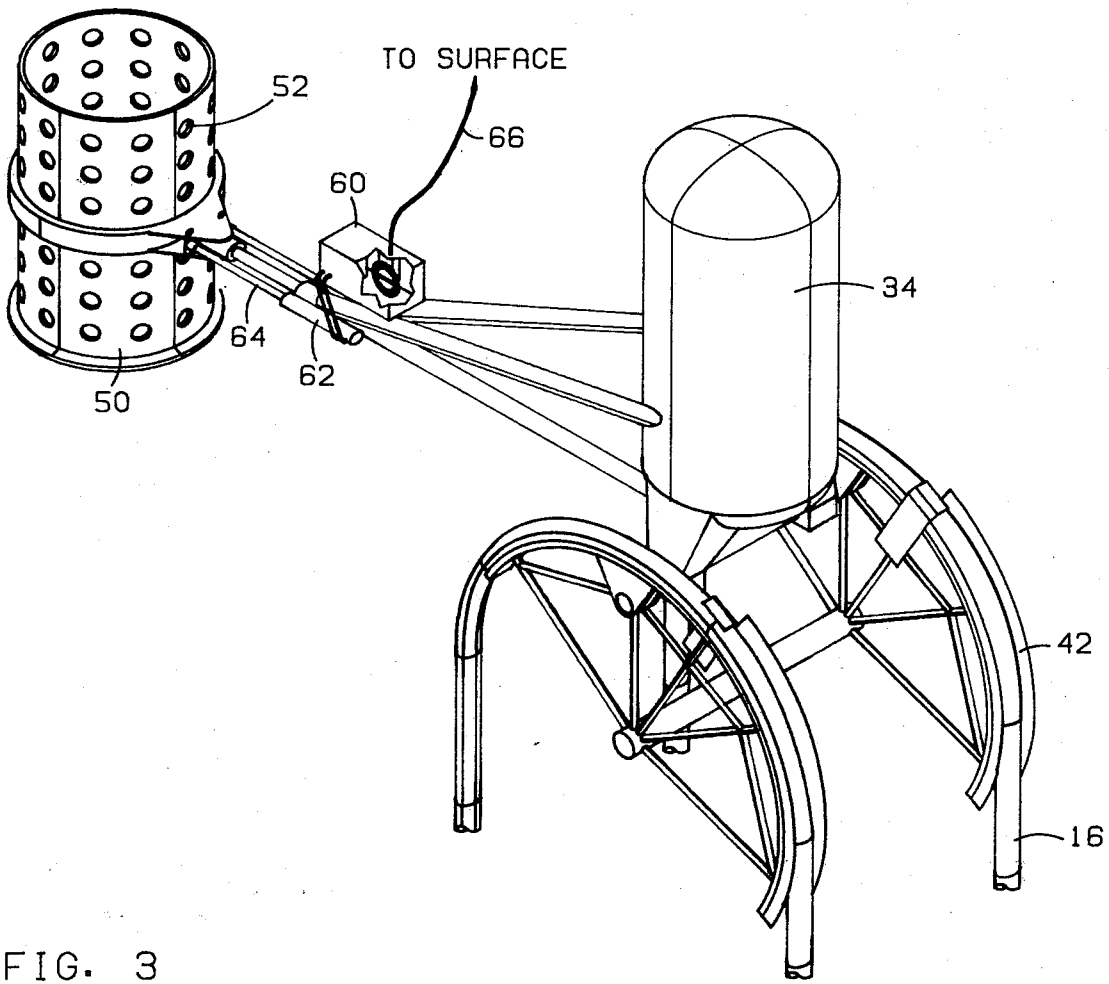
FIG. 3 is similar to FIG. 2 except that means have been provided to sense the orientation of the vertical cylinder and to modify the length of the arm connecting the cylinder to the cradle assembly.
Figure 4:
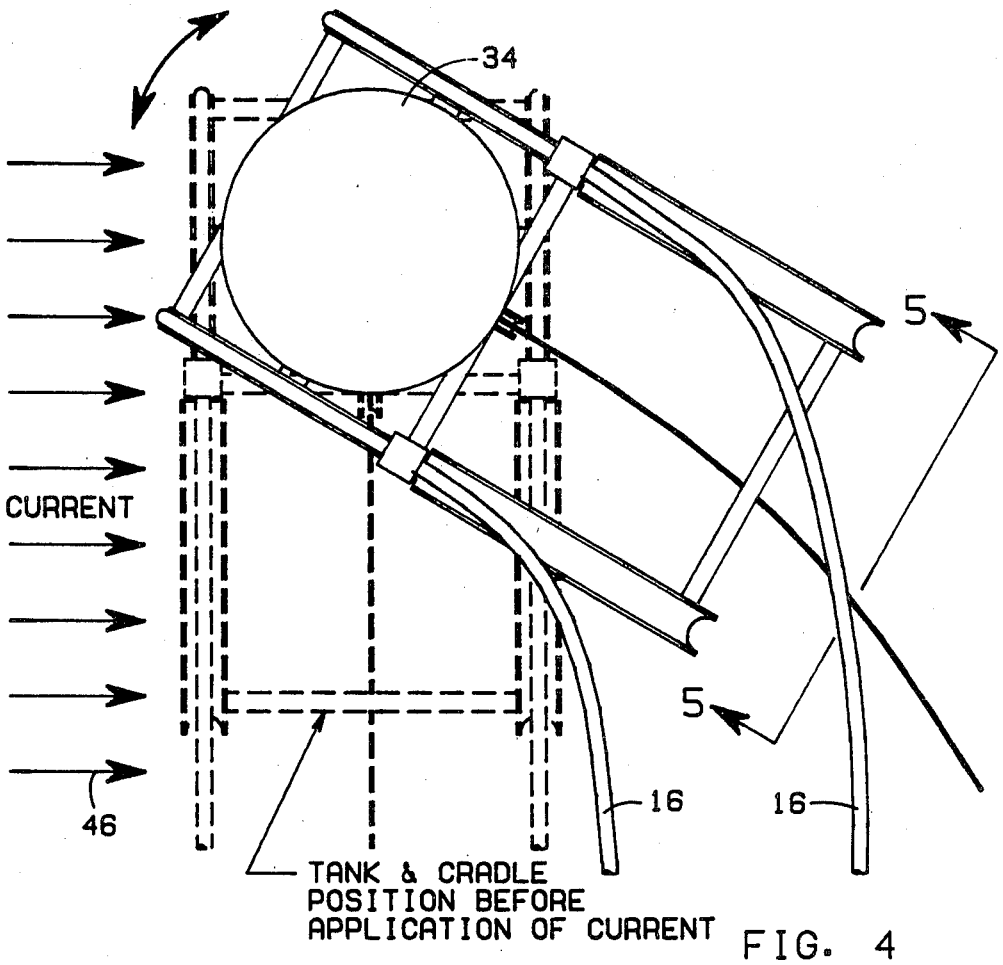
FIG. 4 illustrates the effect of the prior cradle assembly by current perpendicular to the risers when they pass over the cradle.

FIG. 3 is similar to FIG. 4 except means have been provided to sense the vertical orientation and direction of the cylinder 50 and to remotely vary the length of arm means. Shown in FIG. 3 is a controlled box 60 and a two-way cylinder 62 having rods 64. By operating motor 62, the rod 64 can be moved in and out so as to change effective length or distance of the cylinder 50 from the buoy 34. The control box includes a gyroscope, a position indicator for the motor 62, vertical orientation of the system and its direction. The position for the motor, the vertical orientation of the cylinder 50 and the direction of arm can be detected by using commercially available instruments. The signals can be transmitted to the surface through multiple conductor 66. The transmitted signals can be used to determine if the moment balance is correct. If it is correct, the cylinder 50 will have the correct vertical orientation and direction. If it is incorrect, the motor 62 can be operated to either increase or decrease the moment as may be necessary.

While the above description has been made in a rather detail manner, it is possible that various modifications can be made thereto without departing from the spirit or scope of the invention.

What is claimed is:

1. An underwater structure for supporting a flexible riser extending from the bottom of the body of water to a floating vessel comprising:

(a) a cradle assembly having:

(i) a cradle having a receiving surface over which said riser may extend;

(ii) a buoy attached to said cradle (b) a drag balancing tail assembly attached to said cradle assembly to counteract the twisting moment applied to said cradle assembly by current drag forces.

2. The structure as defined in claim 1 in which said drag balancing tail assembly has a neutral buoyancy in water.

3. The structure as defined in claim 1 in which said drag balancing tail assembly includes a vertical open-ended cylinder having perforations in the walls thereof and an arm member connecting said cylinder to said cradle assembly.

4. A structure as defined in claim 3 including means to sense the vertical orientation of said cylinder and the azimuth of said arm.

5. A structure as defined in claim 4 including means to move said cylinder along said arm.

6. A structure as defined in claim 5 including transmitting means to transmit signals indicative of the vertical orientation and azimuth obtained in claim 4 to a remote spot and to control the activation of said cylinder from such spot.

* * * * *